US005989012A

United States Patent [19]

Umfleet

[11] Patent Number: 5,989,012

[45] Date of Patent: Nov. 23, 1999

[54] SMOKELESS SNUFFER

[76] Inventor: Robert Michael Umfleet, 212 S. Main St., Broken Arrow, Okla. 74012

[21] Appl. No.: 09/044,744

[22] Filed: Mar. 19, 1998

[51] Int. Cl.[6] ..... F23Q 25/00; A47J 37/00

[52] U.S. Cl. ..... 431/144; 431/33; 431/120; 126/25 A

[58] Field of Search ..... 431/144, 33, 34, 431/35, 343, 345, 120, 131; D29/127; 7/104; 126/25 A, 25 B

[56] References Cited

U.S. PATENT DOCUMENTS

| | | | |
|---|---|---|---|
| Re. 4,841 | 4/1872 | Stow et al. | 30/131 |
| 601,754 | 4/1898 | Kynast | 431/35 |
| 876,663 | 1/1908 | Smith | 431/120 |
| 1,235,465 | 7/1917 | Hage | 431/144 |
| 1,577,550 | 3/1926 | Woerner | 431/144 |
| 1,740,623 | 12/1929 | Payne | 431/144 |
| 1,822,652 | 9/1931 | Gluckert | 431/144 |
| 1,936,691 | 11/1933 | Soss | 431/144 |
| 3,775,037 | 11/1973 | Sande | 431/144 |
| 3,985,492 | 10/1976 | Nunemaker | 431/144 |
| 4,497,374 | 2/1985 | Millar | 431/144 |
| 5,282,737 | 2/1994 | Ray | 431/144 |
| 5,537,989 | 7/1996 | York, Jr. et al. | 126/406 |
| 5,609,480 | 3/1997 | Boyd | 431/144 |

*Primary Examiner*—James C. Yeung
*Assistant Examiner*—David Lee
*Attorney, Agent, or Firm*—Head, Johnson and Kachigian

[57] ABSTRACT

A candle snuffer having a handle, a body and a hook. The hook submerges a lit candle wick into the adjacent melted wax channel thereby extinguishing said wick. The hook is then used to retrieve the extinguished wick from the melted wax and returning it to its original position.

4 Claims, 2 Drawing Sheets

SMOKELESS SNUFFER

BACKGROUND OF THE INVENTION

1. Field of the Invention

The present invention relates to an apparatus and method for extinguishing lit candles. More specifically, an apparatus method for extinguishing a lit candle while at the same time preventing the extinguished candle from smoking.

2. Prior Art

When a candle is extinguished, the wick will typically continue to emit smoke until such time that it has sufficiently cooled. During this time, the smoke creates an undesirable smell. The prior art discloses devices used to extinguish candles by placing a cap or cone shaped device over the end of a lit candle until such time as candle has been extinguished. These devices, however, do not prevent residual smoke from being emitted from the extinguished candle.

In the prior art, there exists a device which attempts to extinguish the lit candle while at the same preventing residual smoke. Ray (U.S. Pat. No. 5,282,737) discloses a device comprising a tonged shaped snuffer and a water containing vessel. The ends of the tonged shaped snuffer are moistened by the water which is stored within the vessel. The tongs are then pressed against a lit candle, thus extinguishing the flame while attempting to prevent smoke from emitting therefrom. The device has several disadvantages. By utilizing water to extinguish the wick portion of the candle requires the candle to be dried sufficiently before it can be relit. Further, by requiring water, the device becomes cumbersome to transport and operate.

There is a need for a simple snuffing device which can extinguish a flame while simultaneously preventing smoke from emitting therefrom while at the same time being easily transportable and noncumbersome to use.

SUMMARY OF THE INVENTION

This present invention contemplates a candle snuffer in the form of a wire having a handle at one end and a hook at the other. In one embodiment of the present invention, the hook portion has two curves forming an "S". The operation of the snuffer includes pushing a lit candle wick into a pool of melted wax adjacent to said wick with one curve of the S hook. This action would deprive the wick of oxygen thus extinguishing said flame. The second curve portion of the hook would then retrieve the wick from the liquid wax. The wax coating surrounding the wick would immediately congeal thus preventing residual smoke. Another embodiment of the present invention includes the hook having one curve. The targeted candle wick is submerged into and retrieved from a pool of melted wax utilizing the single curve portion of the hook.

The principle objective of the present invention to provide an apparatus and method in which to extinguish a lit candle and simultaneously preventing smoke from emitting therefrom.

Another object of the invention is to provide a simple noncumbersome device to extinguish a lit candle and simultaneously preventing smoke from emitting therefrom.

Another object of the invention is to provide a device to extinguish a lit candle and simultaneously preventing smoke from emitting therefrom without the necessity of using liquids, such as water.

Other objects will impart the obvious and will impart appear hereafter.

DETAILED DESCRIPTION OF THE PREFERRED EMBODIMENTS

Figure 1:
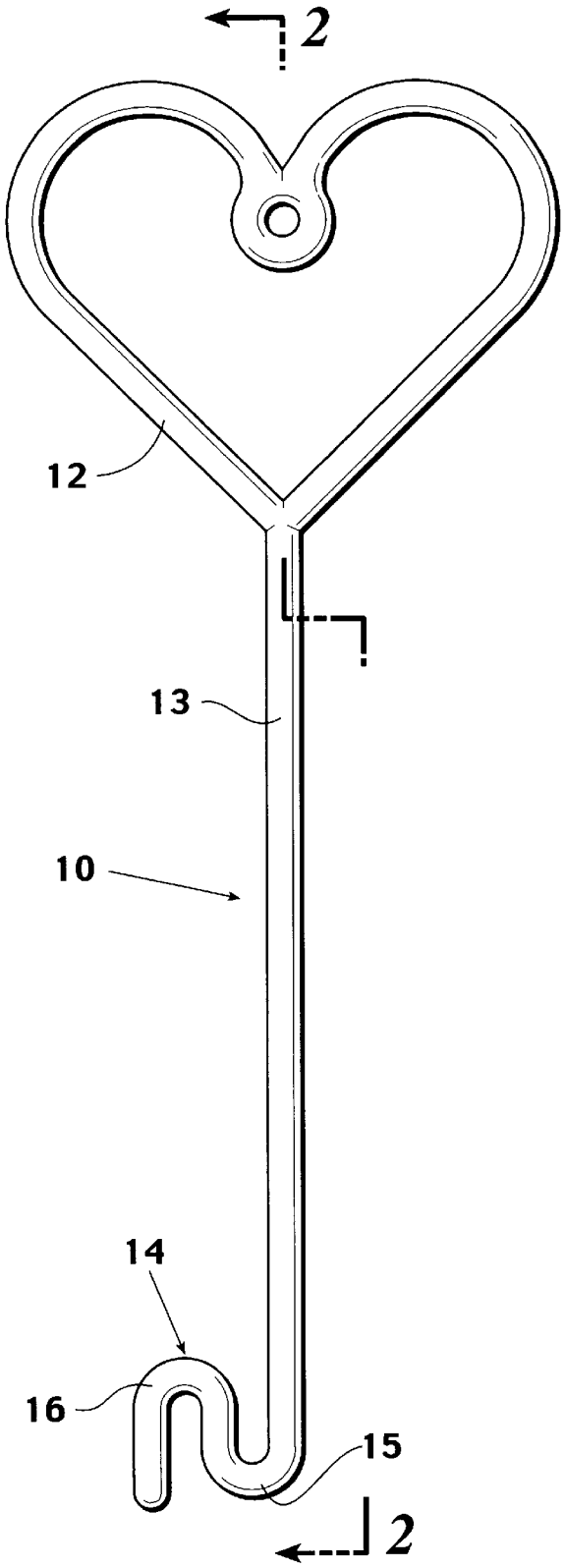
FIG. 1 is a plane view of this invention.
Figure 2:
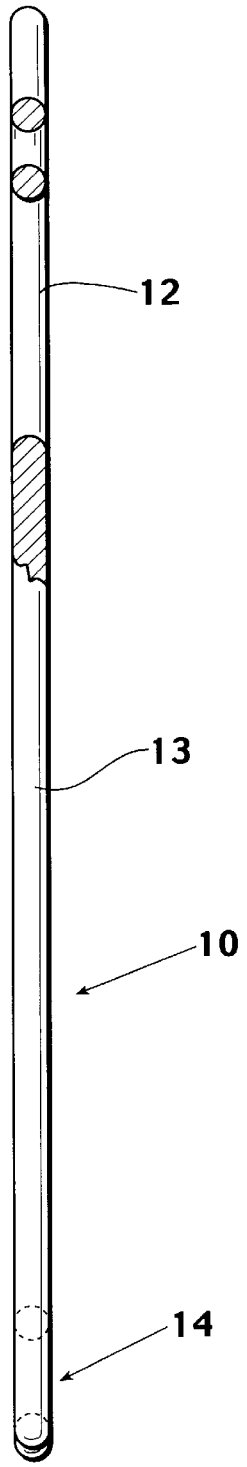
FIG. 2 is a cut away view of the candle snuffer of FIG. 1 along line 2.

Referring now to FIGS. 1–4 candle snuffer 10 having a handle 12 body 13 and hook portion 14 is illustrated. Hook portion 14 has a first curve 15 and a second curve 16.

Figure 3:
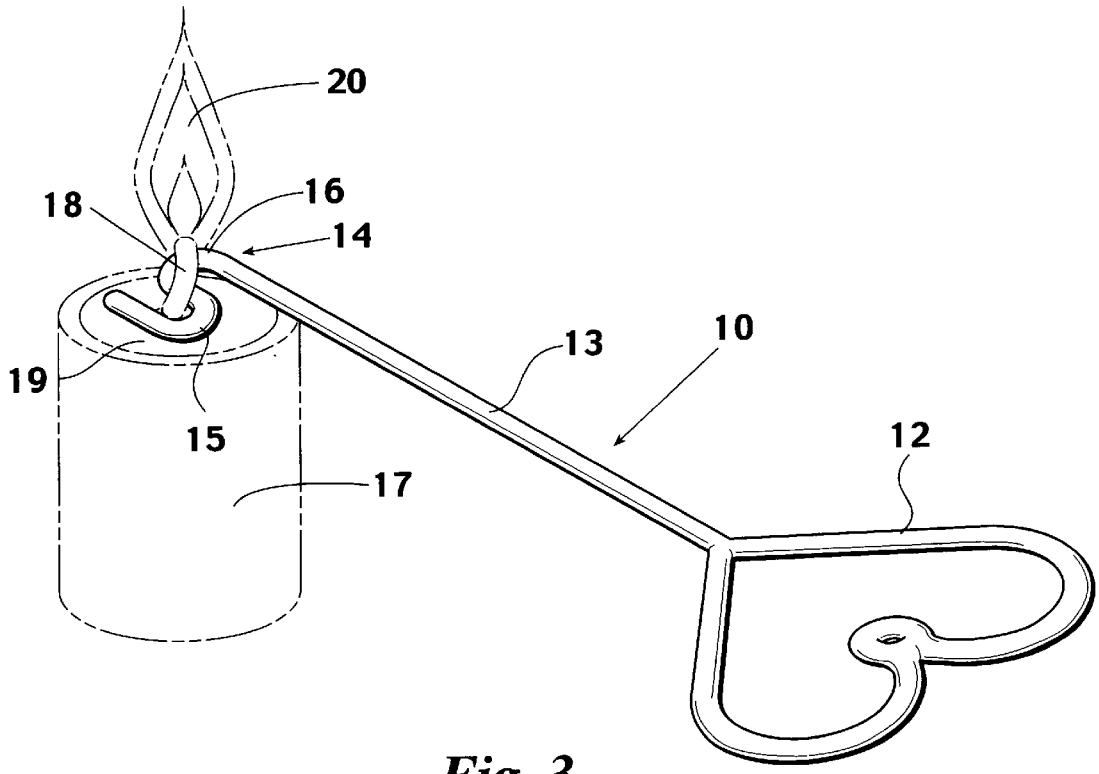
FIG. 3 is a perspective view illustrating the snuffer as it is moved engage the wick of the burning candle.
Figure 4:
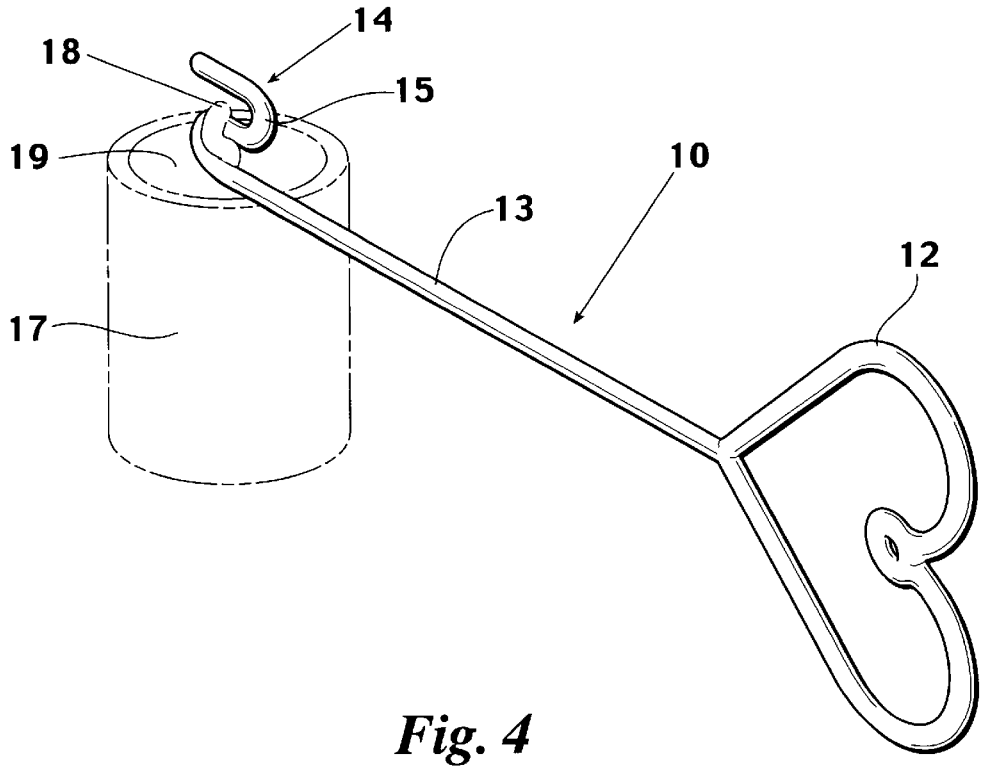
FIG. 4 is a perspective view illustrating the snuffer as it is moved to retrieve the wick of an extinguished candle.

FIGS. 3 and 4 illustrate the manner and manipulation of the snuffer 10 to extinguish flame 20 on wick 18 of candle 17. While grasped by handle 12 first curve 15 of hook 14 is placed around wick 18. By moving snuffer 10 in such a manner as to submerge wick 18 in the liquid wax channel 19 thereby becoming totally encased by liquid wax thus extinguishing flame 20. The second curve 16 of hook 14 is then placed around wick 18 and by movement of the snuffer via handle 12 wick 18 is removed from said liquid wax channel 19. The liquid wax which is encasing wick 18 immediately congeals thus preventing any residual smoke from being emitted therefrom.

Whereas, the present invention has been described in relation to the drawings attached hereto, it should be understood that other and further modifications, apart from those shown or suggested herein, may be made within the spirit and scope of this invention.

What is claimed is:

1. A method for extinguishing a wax candle having a lit candle wick, with a candle snuffer having a first end and a second end, wherein the first end has a handle and the second end having a hook, said method comprising the steps of:

(a) holding the candle snuffer by the handle, (b) pushing the lit candle wick into the melted wax of the wax candle with said hook, so as to extinguish the lit candle wick, (c) pulling the extinguished candle wick out of the melted wax with said hook.

2. A method for extinguishing a wax candle having a lit candle wick with a candle snuffer having a first end and a second end, wherein the first end has a handle and the second end having a hook with a first curve and a second curve, said method comprising the steps of:

(a) holding the candle snuffer by the handle, (b) pushing the lit candle wick into the melted wax of the wax candle with said first curve of the hook, (c) pulling the extinguished candle wick out of the melted wax with said second curve of the hook.

3. A candle snuffer for extinguishing a wax candle having a lit candle wick while simultaneously preventing smoke from emitting therefrom, comprising:

a wire having a first end and a second end wherein said first end is handle shaped and said second end is hook shaped having a first curve and a second curve wherein said first curve is used to extinguish said lit candle wick in the molten wax of said wax candle and said second curve is used to extract the extinguished candlewick from the molten wax.

4. The candle snuffer of claim 3 wherein said first curve and second curve form an "S" configuration wherein said first curve is used to extinguish said candle and said second curve is used to extract the candlewick from the molten wax.

* * * * *